US006009779A

United States Patent [19]

Mastroni

[11] Patent Number: 6,009,779

[45] Date of Patent: Jan. 4, 2000

[54] SCREWDRIVER SET AND KIT HAVING VARIABLE LENGTH INTERCHANGEABLE SCREWDRIVER SHAFTS AND EXTENSIONS

[76] Inventor: Douglas J. Mastroni, 229 Bacon Pond Rd., Unit 444, Woodbury, Conn. 06798

[21] Appl. No.: 09/041,803

[22] Filed: Mar. 13, 1998

Related U.S. Application Data

[60] Provisional application No. 60/042,051, Mar. 15, 1997.

[51] Int. Cl.[7] ..... B25B 23/00

[52] U.S. Cl. ..... 81/438; 81/177.2; 81/177.85

[58] Field of Search ..... 81/437–439, 177.1, 81/177.2, 177.85, 180.1

[56] References Cited

U.S. PATENT DOCUMENTS

| | | | |
|---|---|---|---|
| 1,018,172 | 2/1912 | Downs | 81/177.2 |
| 1,775,402 | 9/1930 | Mandl | 81/177.85 X |
| 2,523,041 | 9/1950 | McKenzie | 81/177.85 X |
| 2,609,851 | 9/1952 | Hadfield | 81/177.1 |
| 2,758,494 | 8/1956 | Jenkins | 81/177.2 X |
| 4,829,976 | 5/1989 | Pourtau et al. | 81/177.1 X |

*Primary Examiner*—D. S. Meislin

*Attorney, Agent, or Firm*—Ware, Fressola, Van Der Sluys & Adolphson LLP

[57] ABSTRACT

The invention provides a screwdriver kit having one or more screwdriver sets for tightening or loosening a fastener such as a regular screw, a Phillips head screw, a socket head, or a hex head. A single screwdriver set may include a screwdriver handle, one or more interchangeable screwdriver extension shafts, and one or more tips for tightening or loosening the regular screw, the Phillips head screw, the socket head, or the hex head. The shafts of the screwdriver handle, the one or more interchangeable screwdriver extension shafts and the tips have wrench mating means for coupling together. The single screwdriver set may include optional washers and one or more wrenches for easily coupling and decoupling the screwdriver set pieces.

10 Claims, 6 Drawing Sheets

SCREWDRIVER SET WITH VARIABLE SHAFT LENGTHS WITH ONLY ONE HANDLE

COMPLIMENTARY WRENCH FOR THE DIFFERENT SHAFT SIZES–
MATING MEANS

SCREWDRIVER SET AND KIT HAVING VARIABLE LENGTH INTERCHANGEABLE SCREWDRIVER SHAFTS AND EXTENSIONS

This application claims benefit to U.S. provisional Ser. No. 60/042,051, filed Mar. 15, 1997, hereby incorporated by reference.

FIELD OF INVENTION

The invention relates to a screwdriver; and more particularly to a screwdriver set and kit.

BACKGROUND OF THE INVENTION

There are many different types of screwdrivers for turning many different types of screws. However, all these screwdrivers suffer from the same problem in that for any given need one can never find a screwdriver having the right length, the right width and the right tip. A person generally has to purchase separate screwdriver units for different length screwdrivers, as well as different size and type screws. This results in many different screwdrivers which add considerable cost to the tool sets of many household, industry and repair garages.

Moreover, many times a person needs to reach a certain screw in a tight spot with a screwdriver that is not long enough or with a screwdriver that has a shaft that is too wide. But when the person switches to a different screwdriver having a longer shaft, unfortunately the tip is too big or small for the screw, or the shaft is too wide for the tight spot.

For all these reasons, there is a real need for a screwdriver having extension shafts so the screwdriver can be lengthened or shortened without changing the size of the tip or the width of the shaft. The inventor is not aware of any screwdriver in which different length extensions can be interchanged for different applications, and he has consulted tool vendors who are also not aware of such a screwdriver.

SUMMARY OF THE INVENTION

The invention provides a screwdriver set and kit having one or more screwdriver sets for tightening or loosening a fastener such as a regular screw, a Phillips head screw, a socket head, or a hex head.

A single screwdriver set may include a screwdriver handle, one or more interchangeable screwdriver extension shafts, and one or more tips for tightening or loosening the regular screw, the Phillips head screw, the socket head, or the hex head. The one or more tips may include tips that are magnetic. The shafts of the screwdriver handle, the one or more interchangeable screwdriver extension shafts and the tips have wrench mating means for coupling together to form a durable shaft having a uniform diameter. The single screwdriver set may include optional washers and one or more wrenches for easily coupling and decoupling the kit pieces.

One or more screwdriver sets may be combined in a screwdriver kit, such as a double screwdriver kit that may include a tightening screwdriver set having handle, extension shaft and tip pieces with clockwise mating threads, and a loosening screwdriver set also having handle, extension shaft and tip pieces with counterclockwise mating threads. The tightening screwdriver set and the loosening screwdriver set have different visual features to help distinguish them apart. For example, the tightening screwdriver set may have a clear handle and extension shafts with a smooth or colored surface, while the loosening screwdriver set may have a gray handle and extension shafts with a rough or different color surface.

The extension shafts have different lengths related in a geometric progression such as one, two, four, . . . , etc. inches; two, four, eight, . . . , etc. inches, or three, six, twelve, . . . , etc. inches, for providing a maximum number of possible extension lengths with a minimum number of extension shafts.

The extension shafts may have abraded or textured surfaces to facilitate the coupling and decoupling thereof by hand.

Another screwdriver kit may include, for example, three different screwdriver sets having a respective handle, extension shaft, and tip that each have shaft diameters dimensioned with 3/16 inches, 1/4 inches and 3/8 inches.

The whole thrust of the present invention is to provide interchangeable screwdriver shafts that will give the user the ability to extend the screwdriver to a desired length, therefore not having to purchase separate screwdriver units having separate lengths. The interchangeable screwdriver shafts will reduce cost to millions of screwdriver users.

Moreover, the screwdriver kit is a useful tool especially for the mechanical repair of automobiles, where many times the auto mechanic has to reach a fastener through a narrow passage that may be over twelve or more inches in length.

BRIEF DESCRIPTION OF THE DRAWING

The drawing, not drawn to scale, includes.

BEST MODE OF THE INVENTION

Figure 1:
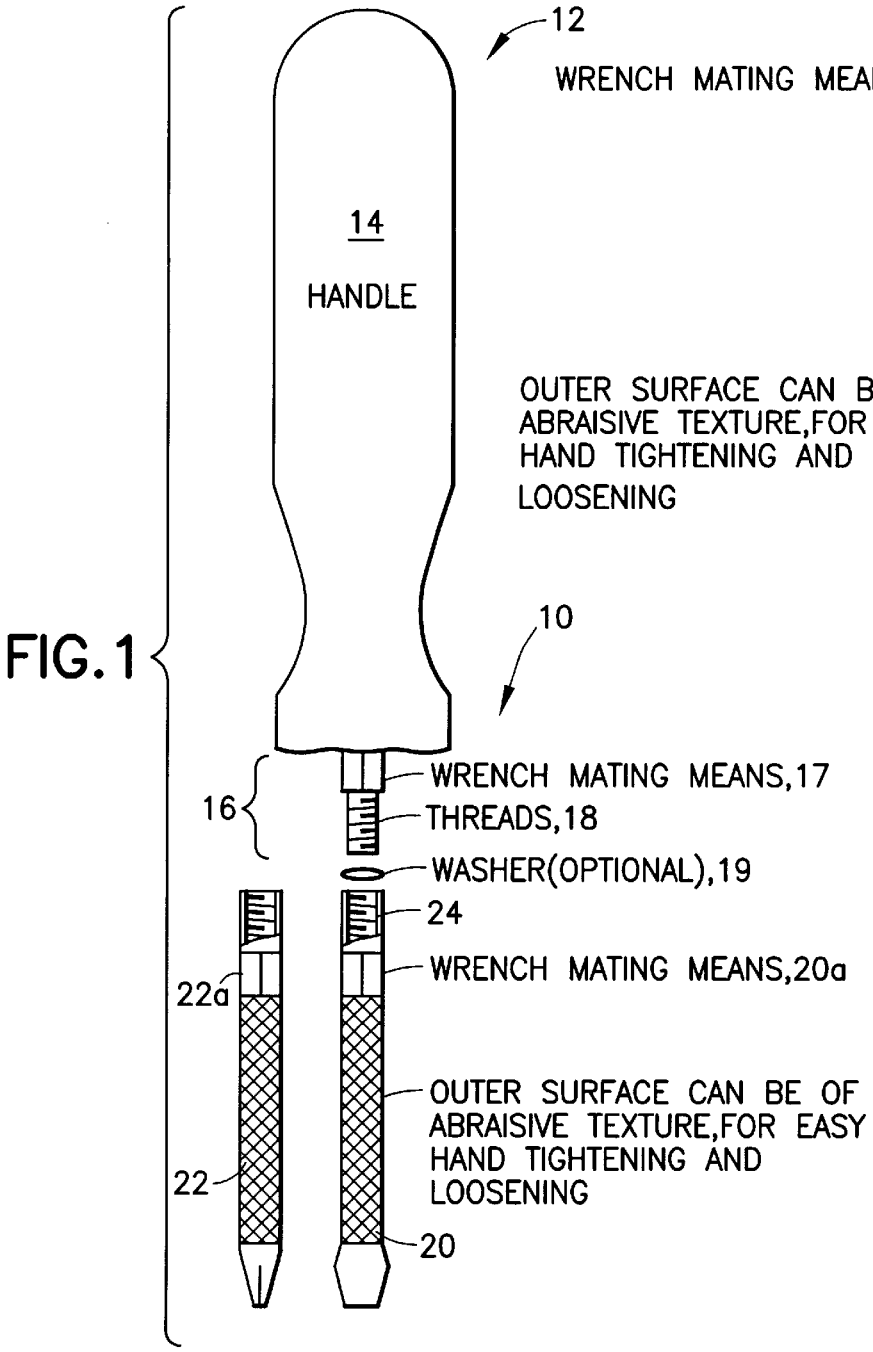
FIG. 1 which is a diagram of one embodiment of a screwdriver set which is the subject matter of the present invention.
Figure 1A:
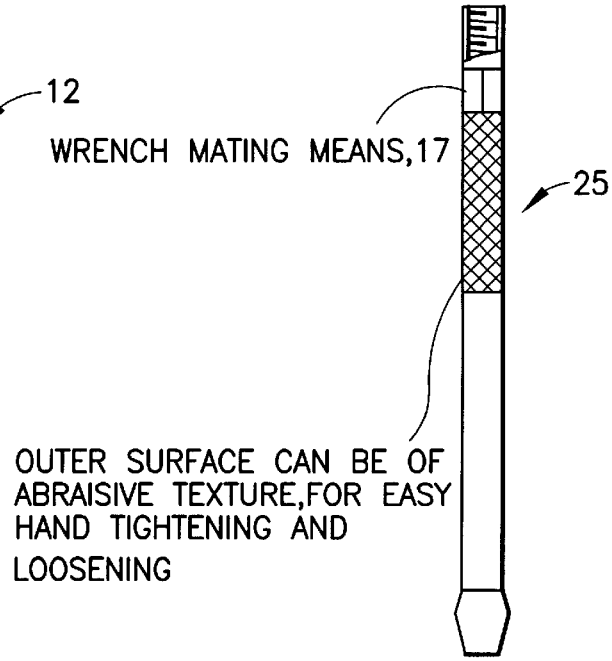

Single Screwdriver Set 10 in FIG. 1

FIG. 1 shows a screwdriver set generally indicated as 10. The screwdriver set 10 includes one or more screwdriver handles generally indicated as 12 and two or more interchangeable screwdriver extension shafts 20, 22. The overall idea of having interchangeable screwdriver shafts will give the user the ability to extend the screwdriver to a desired length, therefore not having to purchase separate screwdriver units. The interchangeable screwdriver shafts will reduce cost to millions of screwdriver users.

Screwdriver Handle 12

Figure 8:
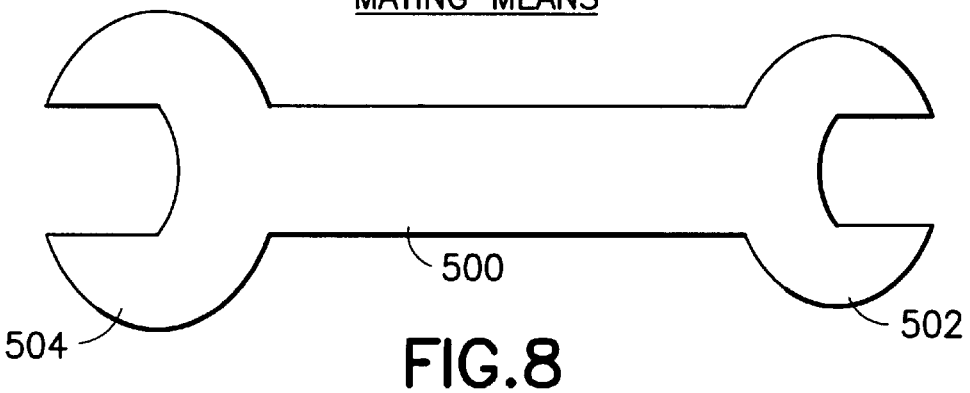
FIG. 8 which is a diagram of a wrench for the screwdriver kit in FIG. 7.

As shown, the screwdriver handle 12 has a screwdriver handle part 14, a shaft generally indicated as 16 and a mating tip 18. The shaft 16 has a wrench mating means 17 for gripping with a wrench (FIG. 8). The screwdriver handle 14 has a longitudinal shape for easy hand gripping. The screwdriver set 10 may include one or more different screwdriver handles with different shapes.

The shaft 16 is ½ of an inch in length, although the scope of the invention is not intended to be limited to any particular shaft length. For example, the screwdriver set 10 may include one or more screwdriver handles having different shaft lengths. The shaft 16 may have a diameter, for example, of 3/16 of an inch, ¼ of an inch, ⅜ of an inch, etc. The screwdriver set 10 may include one or more screwdriver handles having different shaft diameters.

As shown, the mating tip 18 is at the end of the shaft 16. The primary function of the mating tip 18 is to detachably couple to the screwdriver shafts 20, 22 or the extension shafts 32, 34 (FIG. 2) discussed below. As shown, the mating tip 18 has male threads. The screwdriver set 10 may include one or more screwdriver shafts having different mating tips, relating to the other embodiments discussed below. The scope of the invention is not intended to be limited to any particular type, size or shape of the mating tip or the threads.

Interchangeable Screwdriver Shafts 20, 22

The screwdriver set 10 has one or more screwdriver shafts 20, 22. The screwdriver shafts 20, 22 have a length, for example, of 1 inch, 2 inches, 3 inches, . . . , 12 inches, etc. The screwdriver shafts 20, 22 may have a diameter, for example, of 3/16 of an inch, ¼ of an inch, ⅜ of an inch, etc. The screwdriver set 10 may include one or more screwdriver shafts having different lengths and different diameters. Each screwdriver shaft 20, 22 has a corresponding mating means generally indicated as 24 for detachably coupling to the mating tip 18. As shown, the corresponding mating means 24 is corresponding female threads for rotatably receiving the male threads 18 of the screwdriver 12. The scope of the invention is not intended to be limited to which piece has male or female threads. However, it is important to note that when the screwdriver shaft 20, 22 is connected to the shaft 16 of the screwdriver 12, the resulting combined screwdriver shaft has a continuous uniform diameter and durable strength.

Figure 2:
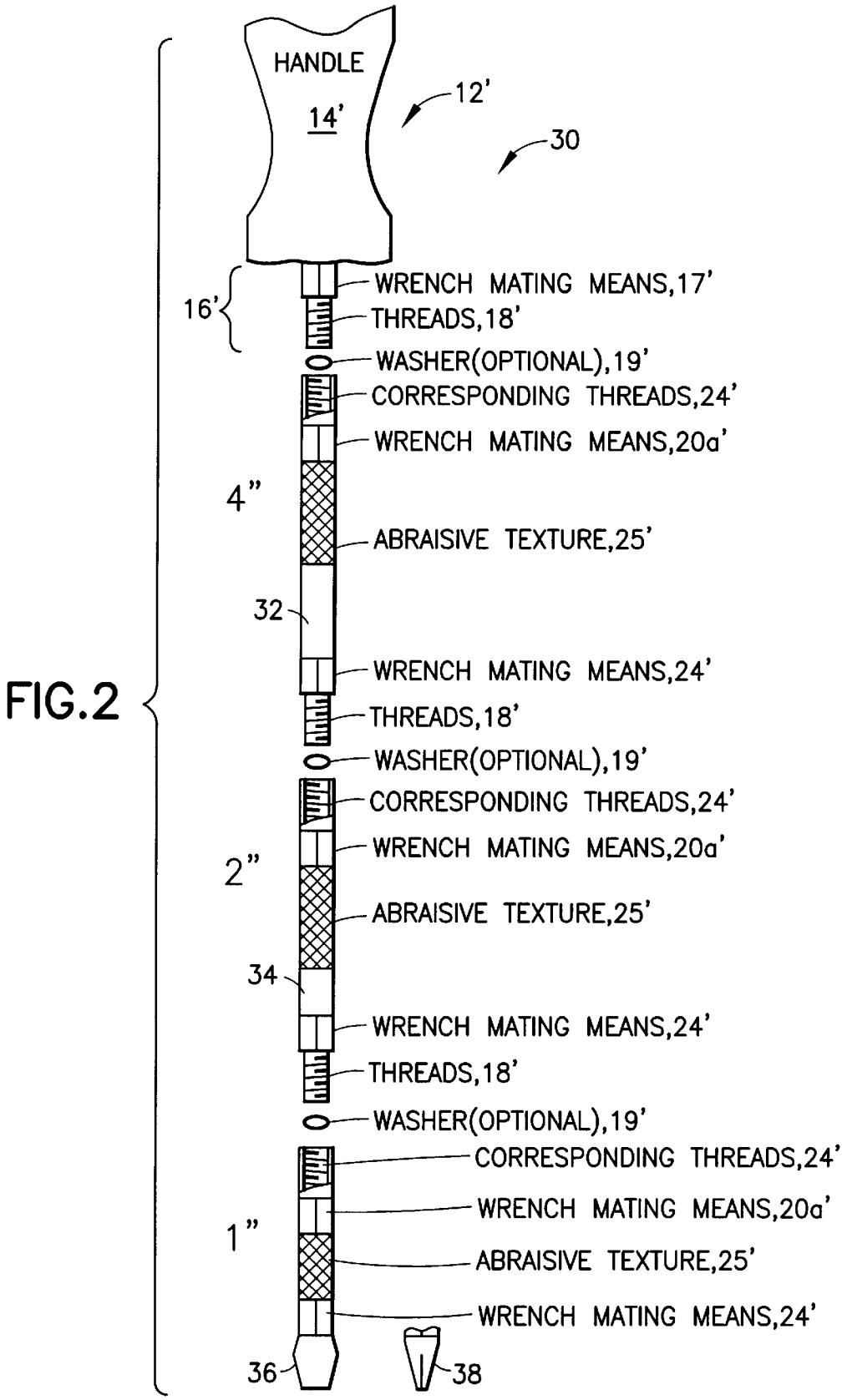
FIG. 2 which is a diagram of another embodiment of the present invention.

The screwdriver shafts 20, 22 also may have respective wrench mating means 20*a*, 22*a* for gripping with a wrench for detaching from the mating tip 18 of the screwdriver 12 from the screwdriver shafts 20, 22 or the extension shafts 32, 34 (FIG. 2). The screwdriver shafts 20, 22 also may have an optional washer 19 and have an abrasive outer texture generally indicated as 25 for easy hand tightening and loosening to and from the mating tip 18 of the screwdriver 12 or to and from the extension shafts 32, 34 (FIG. 2) discussed below.

Screwdriver Set 30 in FIG. 2

FIG. 2 shows an embodiment of another screwdriver set generally indicated as 30 in which the screwdriver set 10 will have a set of extension shafts 32, 34, 36 and a set of screwdriver heads 36, 38. The screwdriver set 10 shown in FIG. 2 has reference labels that substantially correspond to the reference labels in FIG. 1.

As shown, the extension shafts 32, 34 and the screwdriver heads 36, 38 may be used in combination with the embodiment shown in FIG. 1.

Moreover, the screwdriver heads 36, 38 have a length of 1 inch, while the extension shafts 32, 34 can have a binomial progression, such as ½ inch, 1 inch, 2 inches, 4 inches, 8 inches, etc. Such a combination will enable a user to combine one or more of the extension shafts to achieve extension lengths between ½ of an inch to 15½ inches within ½ of an inch. For example, the user can connect the extension shaft having the 1 inch length to get a 1½ inch screwdriver. The user can combine the extension shaft having a 1 inch length and the extension shaft having a 2 inch length to get a combined extension shaft length of 3½ inches.

Each extension shaft 32, 34 has a corresponding mating means generally indicated as 24' for detachably coupling to the mating tip 18'. As shown, the corresponding mating means 24' is corresponding female threads for rotatably receiving the male threads 18' of the screwdriver 12'. The scope of the invention is not intended to be limited to which piece has male or female threads. Similar to that discussed above, when the extension shafts 32, 34 are connected together and to the shaft 16' of the screwdriver 12', the resulting combined screwdriver shaft has a continuous uniform diameter.

Figure 3:
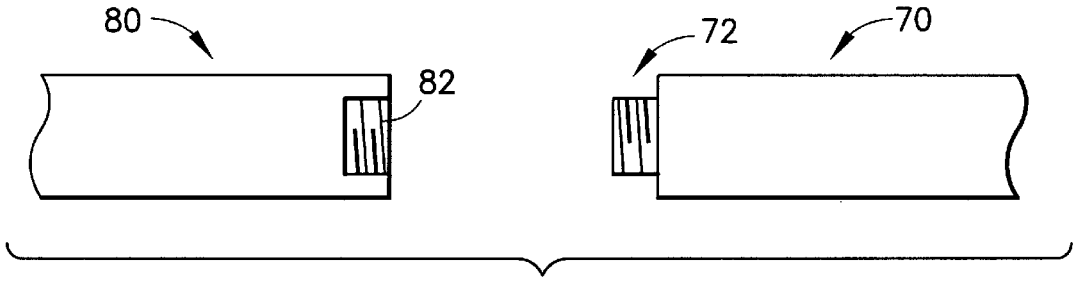
FIG. 3 which is a diagram of the coupling means for the embodiment in FIGS. 1 and 2.

The extension shafts 32, 34 also may have respective wrench mating means 20*a'* for gripping with a wrench for detaching from the mating tip 18' of the screwdriver 12'. The extension shaft 32, 34 also may have an optional washer 19' and have an abrasive outer texture generally indicated as 25' for easy hand tightening and loosening. FIG. 3 shows an enlarged view of the thread coupling between two shafts generally indicated as 70, 80. The shaft 70 has male threads 72. The shaft 80 has female threads 82 on the surface thereof. In operation, for example, the extension shaft 70 can be the shaft 16 of the screwdriver 12 in FIG. 1, and the shaft 80 can be the screwdriver shaft 20, 22.

Figure 4:
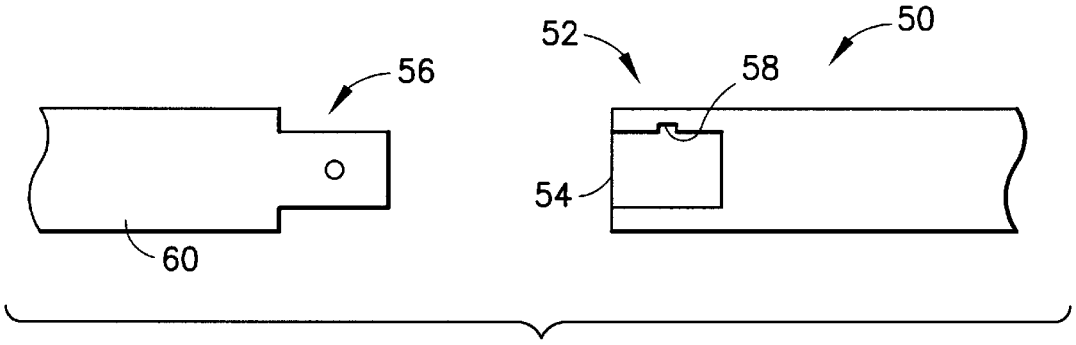
FIG. 4 which is a diagram of still another embodiment of the present invention.

Extension Shaft 40 in FIG. 4

FIG. 4 shows an embodiment in which an extension shaft generally indicated as 40 has a coupling means generally indicated as 42 with a cavity 44 having a shape for receiving a Phillips head screwdriver tip (not shown) when it is fit into the cavity 44. The coupling means 42 also has an annular recess for receiving a ring of material for frictionally engaging the Phillips head screwdriver tip (not shown) in the cavity 44. The ring of material may be rubber that is pliable enough for fitting into the cavity 44 and sturdy enough so as to retain the Phillips head screwdriver tip (not shown) in the cavity 44, but not pull out when the Phillips head screwdriver tip (not shown) is removed.

Figure 5:
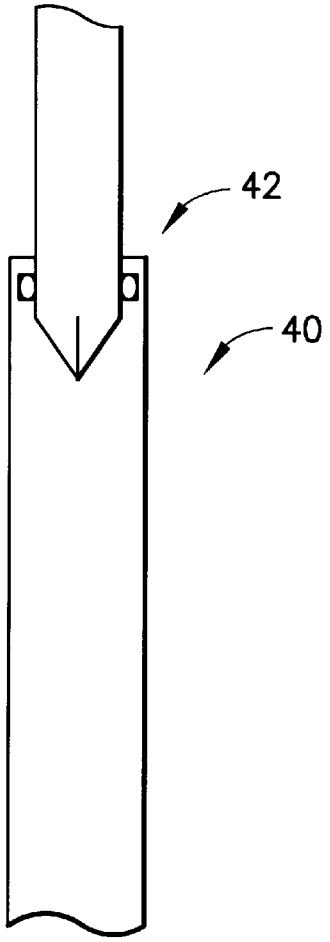
FIG. 5 which is a diagram of still another embodiment of the present invention.

Extension Shaft 50 in FIG. 5

FIG. 5 shows an embodiment in which an extension shaft generally indicated as 50 has a coupling means generally indicated as 52 with a cavity 54 having a shape for receiving a ratchet tip generally indicated as 56 of a shaft 60 when it is fit into the cavity 54. The coupling means 52 also has one or more detents generally indicated as 58 for receiving one or more ratchet bearings generally indicated as 62 for retaining the ratchet tip 56 in the cavity 54. An embodiment is also envisioned in which the extension shaft 50 has a ratchet tip with a ratchet ball bearing, and the shaft 60 has a coupling means having a cavity with one or more detents.

Figure 6:
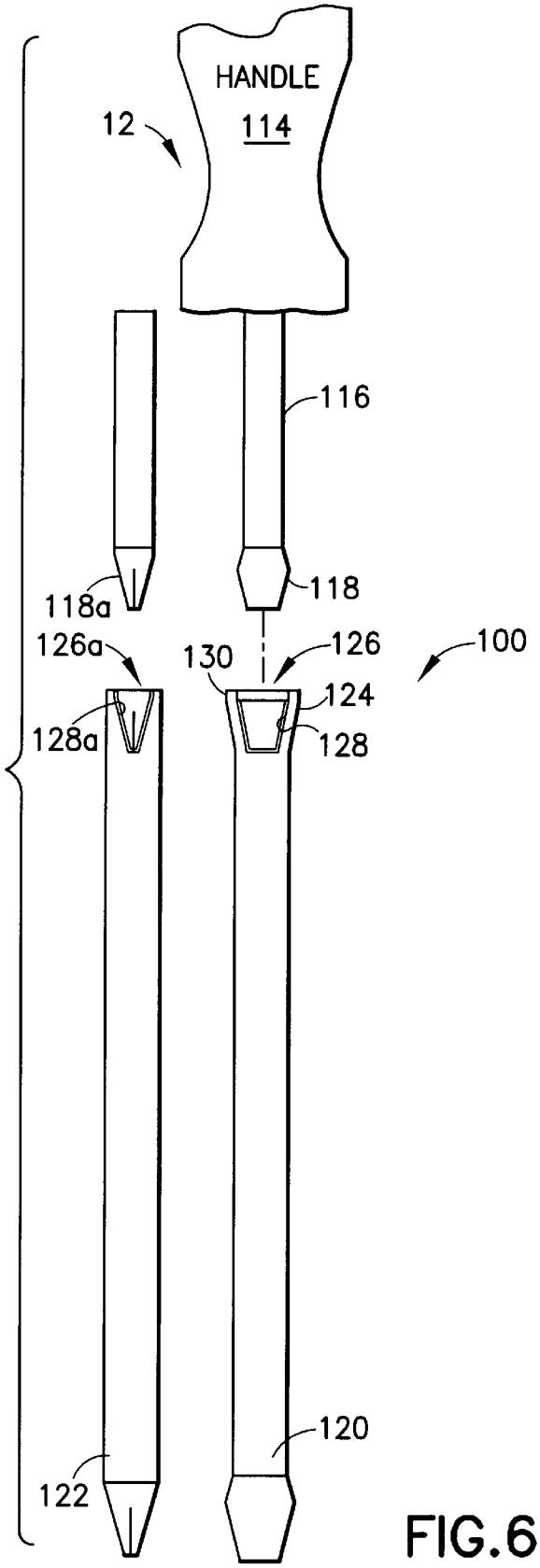
FIG. 6 which is a diagram of still another embodiment of the present invention.

Screwdriver Set 100 in FIG. 6

FIG. 6 shows a screwdriver set generally indicated as 100. The screwdriver set 100 includes one or more screwdrivers generally indicated as 112 and one or more extension shafts 120, 122.

In FIG. 6, the screwdriver set 100 has a screwdriver 112, having a screwdriver handle 114 with a shaft 116 and a mating tip 118. The screwdriver handle 114 is longitudinally shaped for easy hand gripping.

The shaft 116 is two inches in length, although the scope of the invention is not intended to be limited to any particular shaft length. For example, the screwdriver set 100 may include one or more screwdrivers having different shaft lengths. The shaft 116 has a diameter, for example, of 3/16 of an inch, ¼ of an inch, ⅜ of an inch, etc. The screwdriver set 100 may include one or more screwdrivers having different shafts with different diameters.

As shown, the mating tip 118 is at the end of the shaft 116. The primary function of the mating tip 118 is to detachably couple to an extension shaft 120, 122, as discussed in greater detail below. As shown, the mating tip 118 may be a standard screwdriver tip, or may even be a Phillips head screwdriver tip 118*a* having a cross slot, as also shown. The mating tip 118 may be a ratchet tip having a ratchet detent for mating with a corresponding ratchet ball bearing, or may also have a ratchet ball bearing for mating with a corresponding ratchet detent, as discussed below. The screwdriver set 100 may include one or more screwdrivers having different mating tips. The scope of the invention is not intended to be limited to any particular type, size or shape of the tip.

Extension Shafts 120, 122

The screwdriver set 100 has one or more extension shafts 120, 122. The extension shafts 120, 122 have a length, for example, of ½ inch, 1 inch, 2 inches, 3 inches, . . . , 12 inches, etc. In one embodiment, the screwdriver set 100 will have a set of extension shafts 120, 122 having 5 different lengths with a binomial progression, such as ½ inch, 1 inch, 2 inches, 4 inches, 8 inches, etc. Such a combination will enable a user to combine one or more of the extension shafts to achieve extension lengths between ½ of an inch to 15½ inches within ½ of an inch, as discussed above. The extension shafts 120, 122 may have a diameter, for example, of 3/16 of an inch, ¼ of an inch, ⅜ of an inch, etc. The screwdriver set 100 may include one or more extension shafts having different shafts with different diameters.

Extension Shaft Coupling Means 124

As discussed above, each extension shaft 120, 122 has a coupling means generally indicated as 124 for detachably coupling to the mating tip 118. In general, the coupling means 124 may include a cavity 126 for receiving a strong durable rubber material 128 arranged therein that frictionally engages the standard screwdriver tip 118 or the Phillips head screwdriver tip 118*a* when it is fit into the cavity 126. In FIG. 6, the cavity 126 and the strong durable rubber material 128 both are shaped substantially similar to the shape of the mating tip 118, i.e. the cavity 126 has a shape substantially similar to the standard screwdriver tip 118 or the Phillips head screwdriver tip 118*a* for fitting therein. The strong durable rubber material 128 can be frictionally engaged within the cavity 126 in one or more ways. As shown, the strong durable rubber material 128 is retained within the cavity 126 by a lip generally indicated as 130. In operation, when the mating tip 118 is pushed into the strong durable rubber material 128, it forms a tight locking grip. It is important to note that in one embodiment of the invention if a respective shaft 116 of the screwdriver 112 having a diameter, for example ¼ of an inch, is coupled to a respective extension shaft 120 having a corresponding diameter, for example ¼ of an inch, then the diameter of the overall screwdriver does not change. See extension shaft 122. In another embodiment, an upper end of the extension shaft may be flared out slightly. See extension shaft 124.

Figure 7:
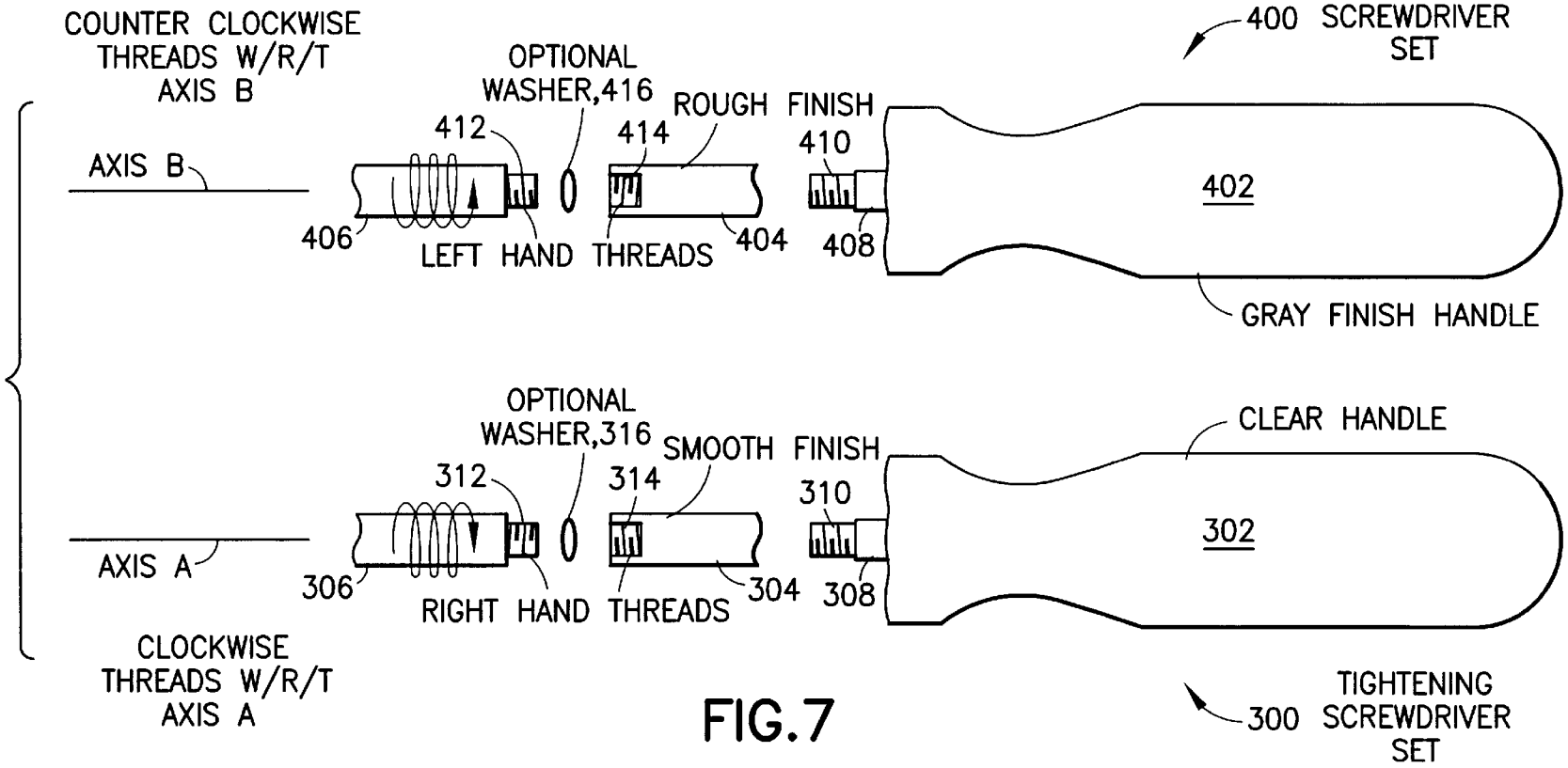
FIG. 7 which is a diagram of a double screwdriver kit for tightening and loosening a fastener, showing in part a clockwise-tightening screwdriver set and a counterclockwise-loosening screwdriver set.

Double Screwdriver Kit 200 in FIG. 7

FIG. 7 shows a double screwdriver kit generally indicated as 200 for tightening or loosening a fastener such as a regular screw (not shown), a Phillips head screw (not shown), a socket head (not shown), or a hex head (not shown). As shown in part, the double screwdriver kit 200 includes a tightening screwdriver set generally indicated as 300, a loosening screwdriver set generally indicated as 400, and one or more wrenches 500 shown in FIG. 8.

The tightening screwdriver set 300 includes a clear handle 302, two or more clockwise-tightening extension shafts 304, 306 and one or more different clockwise-tightening tips similar to those shown in FIG. 2, including a regular screw tip, a Phillips head screw tip, a socket head tip, or a hex head tip. The clear handle 302 has a shaft 308 with outer clockwise-tightening mating threads 310, and may have inscribed therein the word "tighten".

The two or more clockwise-tightening extension shafts 304, 306 may have respective lengths such as three inches, six inches and twelve inches. Each clockwise-tightening extension shaft 304, 306 has respective outer clockwise-tightening mating threads 312, and inner clockwise-tightening mating threads 314 for coupling to the clear handle and to each other to form clockwise-tightening extension lengths of nine, fifteen, eighteen and twenty-one inches, similar to that shown in FIG. 2. Each clockwise-tightening extension shaft 304, 306 has a smooth intermediate surface, and also has respective wrench mating means (that is not specifically shown in FIG. 7 but is similar to the wrench mating means 21*a*' in FIGS. 1–2) between the smooth intermediate surface and respective outer and inner clockwise-tightening mating threads 312, 314.

The different clockwise-tightening tips are shaped to cooperate with the fastener for tightening, and each have respective wrench mating means similar to the wrench mating means 21*a*' in FIGS. 1–2.

Similarly, the loosening screwdriver set 400 for loosening the fastener includes a gray handle 402, two or more counterclockwise-tightening extension shafts 404, 406 and one or more different clockwise-tightening tips similar to those shown in FIG. 2. The gray handle 402 has a shaft 408 with outer clockwise-tightening mating threads 410.

The gray handle 402 has a rough handle surface, has a shaft with outer counterclockwise-tightening mating threads 414, and may have inscribed the words "loosening".

The two or more counterclockwise-tightening extension shafts 404, 406 have respective lengths of three inches, six inches and twelve inches. Each counterclockwise-tightening extension shaft 404, 406 has respective outer counterclockwise-tightening mating threads 412 and inner counterclockwise-tightening mating threads 414 for being coupled to the gray handle 402 and to each other to form counterclockwise-tightening extension lengths of nine, fifteen, eighteen and twenty-one inches. Each counterclockwise-tightening extension shaft 404, 406 has respective wrench mating means (that is not specifically shown in FIG. 7 but is similar to the wrench mating means 21*a*' in FIGS. 1–2) between a rough intermediate surface and respective counterclockwise-tightening mating threads 412, 414.

The different corresponding counterclockwise-tightening tips are similarly shaped to cooperate with the fastener for loosening, and each has respective wrench mating means similar to the wrench mating means 21*a*' in FIGS. 1–2.

Wrench 500 in FIG. 8

FIG. 8 shows the one or more wrenches 500. Each has one or more wrench send 502, 504 formed to cooperate with the wrench mating means similar to the wrench mating means 21*a*' in FIGS. 1–2, for coupling and decoupling the clear handle 302, the clockwise-tightening extension shafts 304, 306 and the clockwise-tightening tips, as well as for coupling and decoupling the non-clear handle 402, the counterclockwise-tightening extension shafts 404, 406 and the clockwise-tightening tips.

The double screwdriver kit 200 has one or more optional washers 316, 416 for facilitating the coupling and decoupling of the kit pieces.

Scope of the Invention

It is also to be understood that the intended claims will be drafted in a regular United States Patent application to cover all of the generic and specific features of the invention herein described and all statements of the scope of the invention which, as a matter of language, might be said to fall therebetween.

I claim:

1. A screwdriver set for tightening or loosening a fastener, comprised of:

a handle having a shaft with male mating threads;

at least two extension shafts, each of said at least two extension shafts having a respective length, each of said at least two extension shafts having respective male mating threads and female mating threads for coupling to the handle and to another one of said at least two extension shafts, each of said at least two extension shafts having a textured intermediate surface thereon, each of said at least two extension shafts having wrench mating means adapted to receive a wrench for turning said at least two extension shafts and being arranged between the textured intermediate surface and each said respective male and female mating threads; and at least two tips shaped for cooperating with the fastener for tightening or loosening thereof, each of said at least two tips having female mating threads for coupling to the handle or one of said at least two extension shafts, each of said at least two tips having a respective different shape for respectively cooperating with a respective different-shaped fastener for tightening or loosening thereof, and each of said at least two tips having respective wrench mating means adapted to receive the wrench for turning said at least two tips.

2. A screwdriver set according to claim 1, wherein said at least two tips includes one of a screwdriver tip, a Philips head tip, a socket head tip or a hex head tip.

3. A screwdriver set according to claim 1, wherein the screwdriver set includes a washer for inserting between said handle and said at least two extension shafts.

4. A screwdriver set according to claim 1, wherein said at least two extension shafts includes three extension shafts having respective different lengths related by a geometric progression, selected from a group having one, two and four inches; two, four and eight inches, or three, six and twelve inches for maximizing the number of possible extension lengths.

5. A screwdriver set according to claim 1, wherein the screwdriver set includes a wrench having a wrench end formed to cooperate with the wrench mating means for coupling and decoupling the handle, said at least one extension shaft and said at least one tip.

6. A double screwdriver kit for tightening or loosening a fastener, comprised of:

(I) a tightening screwdriver set for tightening a fastener comprising:

(A) a clear handle having a shaft with male clockwise-tightening mating threads, (B) two or more clockwise-tightening extension shafts having respective different lengths related by a geometric progression, each clockwise-tightening extension shaft having respective male clockwise-tightening mating threads and female clockwise-tightening mating threads for coupling to the clear handle and to another one of said two or more clockwise-tightening extension shafts to form different clockwise-tightening extension lengths, each clockwise-tightening extension shaft having shaft wrench mating means adapted to receive a wrench for tightening and loosening said each clockwise-tightening extension shaft and being arranged between a smooth intermediate surface and each respective male and female clockwise-tightening mating threads, and (C) at least one clockwise-tightening tip, each of said at least one clockwise-tightening tip shaped to cooperate with a different fastener for tightening thereof, each of said at least one clockwise-tightening tip having tip wrench mating means adapted to receive a wrench for tightening said each clockwise-tightening tip;

(II) a loosening screwdriver set for loosening the fastener comprising:

(A) a gray handle having a rough handle intermediate surface, and having a shaft with male or female counterclockwise-loosening mating threads, (B) two or more counterclockwise-loosening extension shafts having respective increasing lengths related in a geometric progression, each counterclockwise-loosening extension shaft having respective male counterclockwise-loosening mating threads and female counterclockwise-loosening mating threads for being coupled to the gray handle and to each other to form different counterclockwise-loosening extension lengths, each counterclockwise-loosening extension shaft having second shaft wrench mating means adapted to receive a wrench for loosening said each counterclockwise-loosening extension shaft and being arranged between a rough intermediate surface and each respective male and female counterclockwise-loosening mating threads, and (C) at least one counterclockwise-loosening tip shaped to cooperate with a fastener for loosening thereof, each of said at least one corresponding counterclockwise-loosening tip having second tip wrench mating means adapted to receive a wrench for loosening said each counterclockwise-loosening tip; and (III) a wrench having a wrench end formed to cooperate with the shaft wrench mating means, the tip wrench mating means, the second shaft wrench mating means or the second tip wrench mating means for coupling and decoupling the clear handle, the two or more clockwise-tightening extension shafts and the at least one clockwise-tightening tip, as well as for coupling and decoupling the gray handle, the two or more counterclockwise-loosening extension shafts and the at least one counterclockwise-loosening tip.

7. A double screwdriver kit according to claim 6, wherein the at least one clockwise-tightening tip and the at least one counterclockwise-loosening tip include one of a screwdriver tip, a Philips head tip, a socket head tip or a hex head tip.

8. A double screwdriver kit according to claim 6, wherein the double screwdriver kit includes at least one washer.

9. A double screwdriver kit according to claim 6, wherein the increasing lengths of the geometric progression of the extension shafts include lengths of three, six and twelve inches for forming into combined extension shaft lengths of nine, fifteen, eighteen and twenty-one inches.

10. A screwdriver set according to claim 1, wherein the screwdriver set includes a washer for inserting between a first one of said at least two extension shafts and a second one of said at least two extension shafts.

* * * * *